US006008571A

United States Patent [19]

Van Oekel et al.

[11] Patent Number: 6,008,571

[45] Date of Patent: Dec. 28, 1999

[54] COLOR CATHODE RAY TUBE HAVING A SHADOW MASK PROVIDED WITH AN ANTI-BACKSCATTERING LAYER

[75] Inventors: Jacques J. Van Oekel; Michael J. M. J. Severens; Gerarda M. H. Timmermans; Maria C. Van Uden; Marcel Brouha, all of Eindhoven, Netherlands

[73] Assignee: U.S. Philips Corporation, New York, N.Y.

[21] Appl. No.: 08/946,781

[22] Filed: Oct. 8, 1997

[30] Foreign Application Priority Data

Oct. 11, 1996 [EP] European Pat. Off. ..... 96202840

[51] Int. Cl.[6] ..... H01J 29/07

[52] U.S. Cl. ..... 313/402; 313/407

[58] Field of Search ..... 313/402, 404, 313/407, 408, 403, 326, 489

[56] References Cited

U.S. PATENT DOCUMENTS

| | | | |
|---|---|---|---|
| 3,885,190 | 5/1975 | Taniguchi et al. | 313/402 |
| 4,629,932 | 12/1986 | Tokita | 313/402 |
| 4,734,615 | 3/1988 | Koike et al. | 313/402 |
| 4,771,214 | 9/1988 | Takemaka et al. | 313/479 |
| 5,078,812 | 1/1992 | McCoy et al. | 148/270 |
| 5,170,093 | 12/1992 | Yamamoto et al. | 313/402 |
| 5,578,898 | 11/1996 | Higashinakagawa et al. | 313/402 |
| 5,757,119 | 5/1998 | Togawa | 313/402 |

*Primary Examiner*—Vip Patel
*Assistant Examiner*—Matthew J. Gerike
*Attorney, Agent, or Firm*—John C. Fox

[57] ABSTRACT

A color cathode ray tube has a shadow mask. The shadow mask is provided with a layer of a material having an average Z number below 20 on the side facing the phosphor screen. The layer is preferable deposited by means of electrodeposition.

4 Claims, 3 Drawing Sheets

COLOR CATHODE RAY TUBE HAVING A SHADOW MASK PROVIDED WITH AN ANTI-BACKSCATTERING LAYER

BACKGROUND OF THE INVENTION

The invention relates to a colour cathode ray tube comprising a means for generating electrons, an electroluminescent phosphor screen, and a colour selection electrode positioned between the means and the phosphor screen.

The invention also relates to a method of manufacturing a colour selection electrode for a colour cathode ray tube.

Such colour cathode ray tubes are known, and they are used, e.g. in television apparatuses and computer monitors. Such cathode ray tubes comprise, within an evacuated envelope, a means for generating electrons, usually three co-planar electron beams, and an electroluminescent screen on which the electrons impinge. Between the electron beam-generating means and the phosphor screen there is provided a colour selection electrode (sometimes also referred to as a shadow mask).

An important aspect of a colour cathode ray tube is the quality of the image displayed on the phosphor screen.

OBJECTS AND SUMMARY OF THE INVENTION

It is an object of the invention to improve the image quality of a colour cathode ray tube of the type mentioned in the first paragraph.

To this end a colour cathode ray tube according to the invention is characterized in that the colour selection electrode is covered, at least at the surface of the colour selection electrode facing the phosphor screen, with a layer of an electrically non-conducting material having an average atomic number Z of less than 20 ($Z<20$).

The provision of the layer increases the contrast of the image on the phosphor screen and improves the colour rendition of the image, as will be explained hereinbelow.

The inventors have realized that when an electron beam impinges on the phosphor screen part of the beam is reflected and impinges on the shadow mask. These so-called "backscattered" electrons may be reflected back to the phosphor screen by the shadow mask. Backscattered electrons, upon impinging on the phosphor screen, cause stray light to be formed. Said stray light reduces the contrast. Provision of a layer of a material having a low average atomic number Z (below 20, preferably $\leqq 10$) reduces the number of stray electrons reaching the phosphor screen, resulting in an increases of the contrast.

The provision of the layer may cause loose particles to be formed. Such loose particles are detrimental to the performance of the means for generating the electron beams, in particular if such particles are electrically conducting. The inventors have realized that provision of a layer of a non-conducting material reduces the detrimental effects of the provision of the layer.

In embodiments of the invention, the material with a low Z number comprises a material of the group formed by $Al_2O_3$ (Aluminum Oxide), $SiO_2$ (Silicon Oxide) and BN (Boron-Nitride). Such materials have been found to give good results. Preferably $Al_2O_3$ is used.

Preferably, the average thickness of the layer of material with a low Z number provided on the shadow mask on the surface facing the phosphor screen lies between 0.5 and 4.5 $\mu$m. In this thickness range the contrast, which is an important aspect of the quality of the image as perceived by a viewer, is increased. Applying a layer of greater thickness (more than 4.5 $\mu$m), reduces the luminance of the image which is also an important aspect of the image quality. For the two most commonly used types of colour selection electrodes, the optimum improvement in image quality occurs at slightly different thickness ranges. For a colour selection electrode of the slotted type the thickness of the layer is preferably between 1.5 and 4 $\mu$m, for a colour selection electrode of the hexagonal type the thickness of the layer is preferably between 1 and 3 $\mu$m.

Preferably, the layer is provided by means of electrodeposition (cataphoresis). Electrodeposition enables a smooth layer having a sufficiently uniform thickness to be deposited on the colour selection electrode. In the electrodeposition process, the colour selection electrode is immersed in a suspension comprising the material of the layer (e.g. $Al_2O_3$). Application of an electric potential difference between the colour selection electrode and a counterelectrode (anode) submersed in the suspension causes the material of the layer to be deposited on the colour selection electrode. Subsequently the mask is removed from the bath, rinsed in a rinsing bath and dried. Although, when the colour selection electrode is pulled out of the suspension, some of the suspension remains in the holes, which could cause blocking of the holes in the colour selection electrode, it has experimentally been found that such blocking of the holes does not take place. During drying of the suspension, the liquid film in the holes bursts open, and a smooth layer is formed. The method of the invention is characterized in that by means of cataphoresis a layer of a non-conducting material having a low Z number is deposited on the colour selection electrode. Preferably, the layer thickness of the deposited layer ranges between 0.5 and 4.5 $\mu$m.

BRIEF DESCRIPTION OF THE DRAWINGS

These and further aspects of the invention will be explained in greater detail by means of an example and with reference to the accompanying drawing, in which.

DESCRIPTION OF THE PREFERRED EMBODIMENTS

Figure 1:
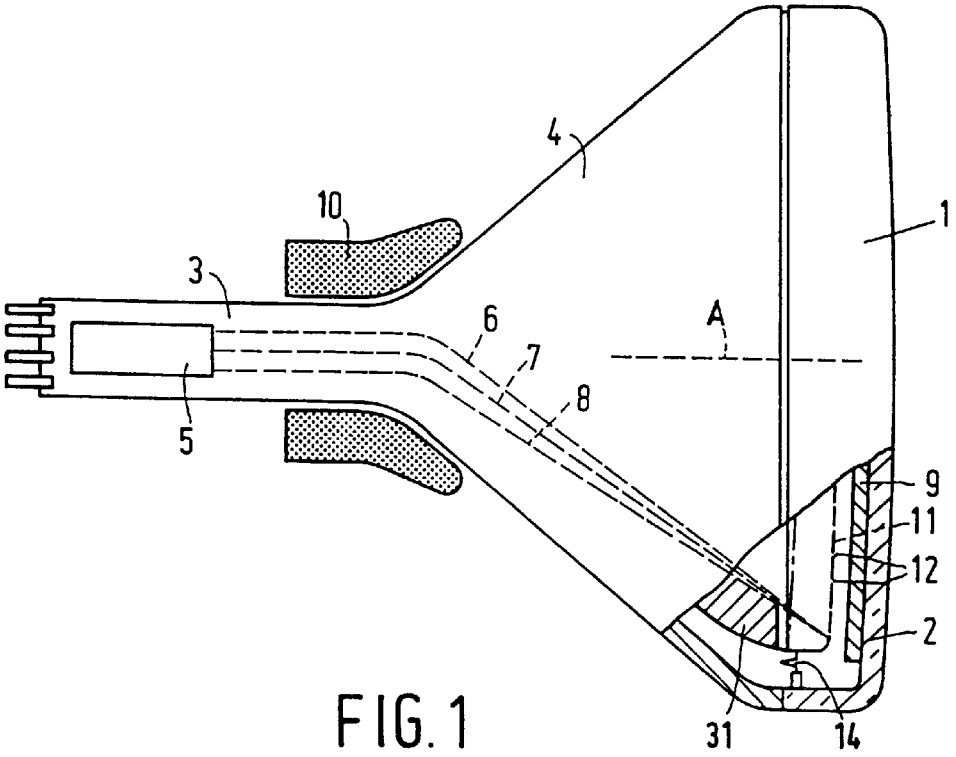
FIG. 1 shows a colour cathode ray tube

FIG. 1 is a partly perspective view of a cathode ray tube 1. Said cathode ray tube 1 comprises an evacuated envelope 3 having a display window 2 and a neck 4. In the neck there is provided an electron gun 5 for generating, in this example, three electron beams 6, 7 and 8. On the inside of the display window 3 there is provided a luminescent display screen 9 which, in this example, comprises phosphor elements luminescing in red, green and blue. On their way to the screen 9, said electron beams 6, 7 and 8 are deflected across the screen 9 by means of a deflection unit 10, which is located at the junction between the neck and the cone, and pass through the colour selection electrode, in this example the shadow mask 11 which comprises a thin plate having apertures 12. The electron beams 6, 7 and 8 pass through said apertures 12 at a small angle with respect to each other and each electron beam impinges on phosphor elements of only one colour. The colour selection electrode is suspended by means of supporting means 14. In general, an equally high voltage is applied to the screen and the shadow mask (25–30 kVolts). In this example, an internal magnetic shield (IMS) 31 is attached to the colour selection electrode or to a frame of the colour selection electrode or to the supporting means.

Figure 2:
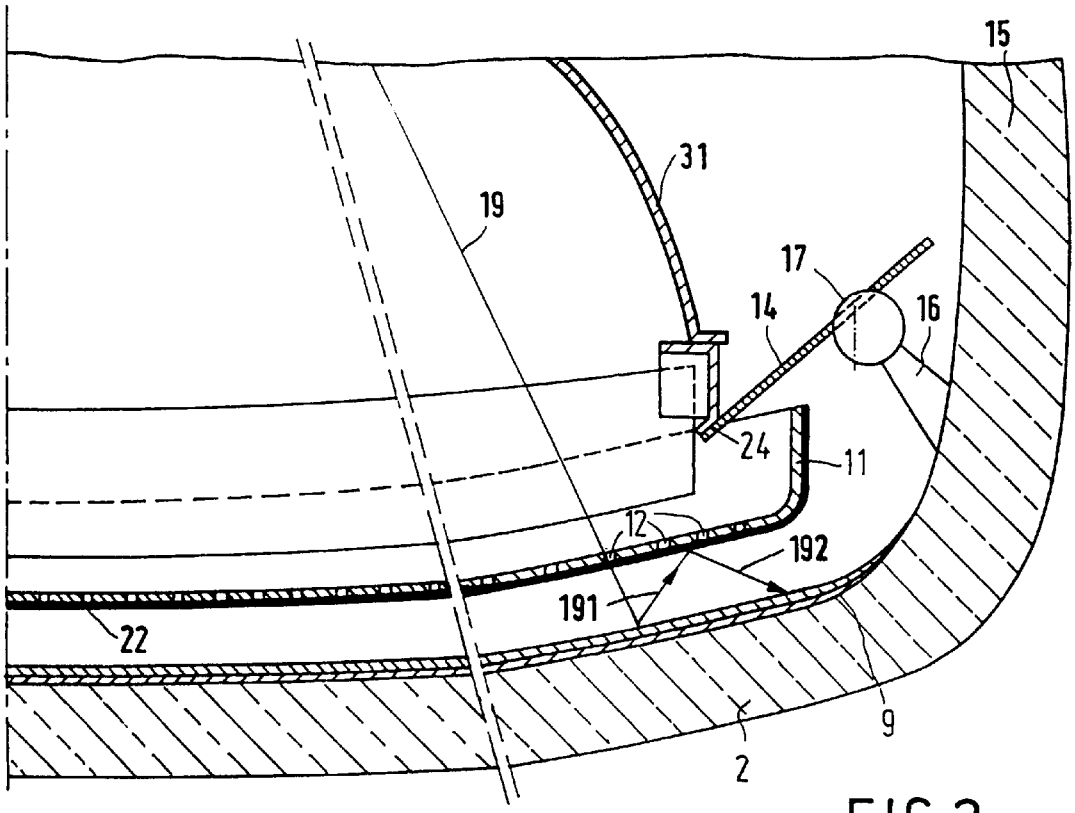
FIG. 2 shows a detail of a colour selection electrode FIG. 3A graphically shows the relation between the luminance and the thickness of the layer.

FIG. 2 is a sectional view of a colour display tube, showing in more detail a shadow mask 11, suspended in front of the screen 9. In this example, the display window has a raised edge 15 in the corners of which supporting means, for example in the form of pins 16 having a free end portion 17, are provided. The free end portion 17 of the pin 16 projects partly in an aperture in a resilient element of the suspension means. The shadow mask 11 is attached to a frame 24 to increase the sturdiness of the shadow mask. Electron beam 19 passes through aperture 20 in the shadow mask and is incident on a phosphor element of screen 9. The way in which the shadow mask is suspended is not essential, within the framework of the invention, and FIG. 2 merely shows an example. The electron beam 19, upon impinging on the phosphor screen, releases part or all of its kinetic energy and excites the phosphor, which emits light through the display window 2.

Some of the electrons, however, are reflected by the screen 9, (in FIG. 2 schematically shown by arrow 191) and impinge on the shadow mask 11. Said electrons 191 may be back scattered by said shadow mask in FIG. 2, this process is schematically indicated by arrow 192. When these back scattered electrons 192 impinge on the phosphor screen, they excite said phosphor screen, thereby causing unwanted stray-light emission which, reduces the image quality. The decrease of the image quality may manifest itself as a decrease in contrast, a change in colour point, or otherwise. The object of the invention is to reduce the above-mentioned effects, thereby increasing the image quality.

To this end the shadow mask is provided, at least on the side of the shadow mask facing the phosphor screen 9, with a layer 22 of a non-conducting material having a low average atomic number (Z<20). Within the framework of the invention, the average Z-number of a material is defined as follows:

For a material of composition $A_xB_yC_z$, the average Z-number is $(x*Z_A+y*Z_B+z*Z_C)/(x+y+z)$. Thus for $Al_2O_3$ the average Z-number is (2*13+3*8)/5=10. For $Fe_2O_3$ the average Z-number is 2.0.

Provision of a layer with an average Z number lower than 20 reduces the number and energy of the backscattered electrons 192, thereby reducing stray-light emission. The fact that the layer 22 is non-conductive has the important advantage that, if any loose particles should become detached from the layer 22 they do not adversely affect the rest of the tube. Conducting materials cause short-circuits particularly in the means for generating electrons. In this respect carbon is to be considered a conducting material. Carbon particles cause short-circuits and emit stray electrons.

In embodiments of the invention, the material with a low Z number comprises a material of the group formed by oxides or nitrides, e.g. $Al_2O_3$ (Aluminum Oxide), $SiO_2$ (Silicon Oxide) and BN (Boron-Nitride). Carbides may also be used. Such materials have been found to give good results. Preferably, $Al_2O_3$ is used. Oxides and nitrides are usually inert materials which can withstand the temperatures used during the manufacture of a CRT and do not cause contamination of the vacuum in the tube.

Figure 3A:
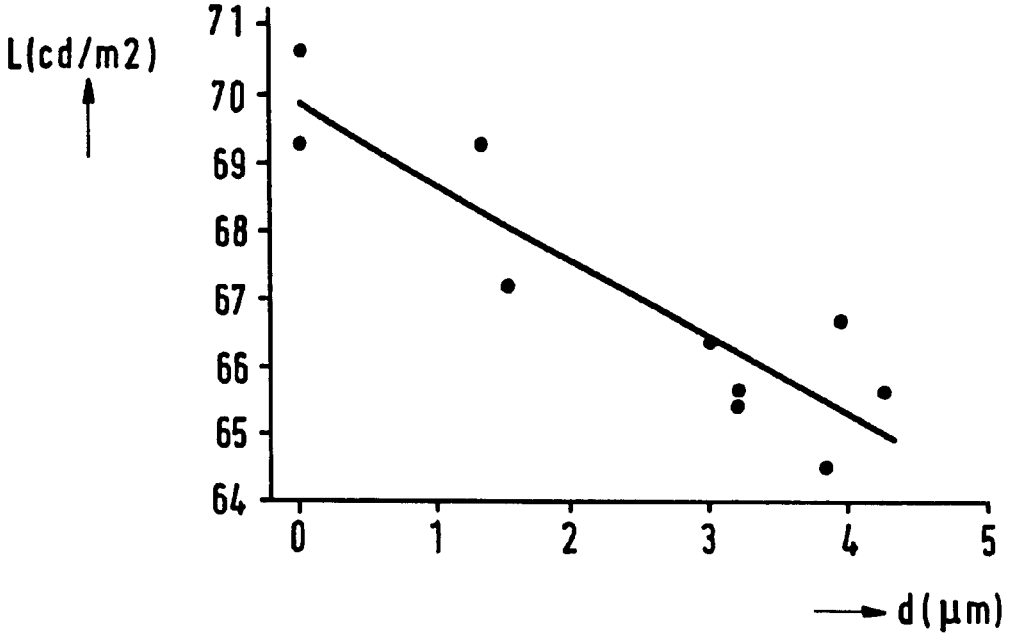
FIG. 3B graphically shows the relation between the contrast and the thickness of the layer.
Figure 3B:
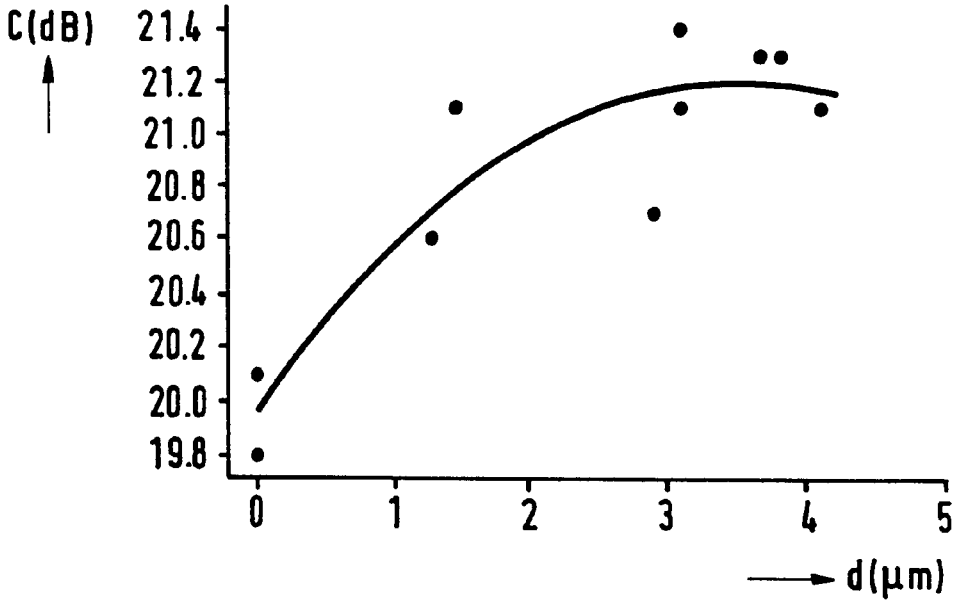

FIGS. 3A and 3B show, as a function of the thickness d of a layer of $Al_2O_3$ on the mask (in $\mu$m), the luminance L (in cd/m$^2$) and the contrast C (in dB) for the central region of the mask, respectively. As the thickness d of the layer 22 increases, the contrast C increases until it reaches a maximum. The contrast is measured in a dark environment and defined by:

$$C_{db}=|10^{10}\log(L_{min}/L_{max})|$$

where $L_{max}$ is measured at a bright part of a test picture and $L_{min}$ is measured at a dark part of a test picture. An increase of C by 1 means that $L_{min}$ (for the same $L_{max}$) is decreased by approximately 26%. An increase in C of approximately 0.5 is visible to the naked eye. The luminance L, however, decreases as the thickness d of layer 22 is increased. The visual performance of the colour cathode ray tube depends on both parameters and therefore the thickness of layer 22 preferably ranges between 0.5 and 4.5 $\mu$m, For values lower than 0.5 $\mu$m the increase in contrast is small, for higher values the luminance decreases appreciably. In respect of the thicknesses in FIGS. 3A and 3B the following observation is made. The $Al_2O_3$ layer is somewhat porous, the estimated packing ratio being 65% (i.e. 65% of the layer is $Al_2O_3$, the rest is vacuum). Depending on the density of the layer the peak in the range of preferred thicknesses could shift slightly to thicker or thinner layers. In general, the denser the layer, the better the performance of the colour cathode ray tube is. In the case of a low packing ratio a thicker layer is required to reach a desired increase in contrast. However, at a greater thickness, the decrease in luminance is larger. For instance at a packing ratio of 50–65%, a layer having a thickness of 2 $\mu$m results in an increase of the contrast C of approximately 1 dB (FIG. 3B), and in a decrease in the luminance L of approximately 4% (FIG. 3A). A layer with a lower packing ratio, for instance 30%, should be 4 $\mu$m thick to achieve the same increase in contrast C. The decrease in luminance L would, however, be doubled to 8%. Preferably, the packing ratio of the layer is 50%. The packing ratio of a layer can be determined, e.g. by measuring the average thickness of a layer and the weight/cm ratio. By means of these parameters, the specific weight in gram/cc can be determined. The ratio between the specific weight of the layer and the specific weight of the material of which the layer is made is the packing ratio. Packing ratios can also be determined by means of images, for instance SEM-images. High packing ratios further have the advantage that the adhesion between the particles is strongly improved. The possibility that a particle becomes detached (thus becoming a loose particle) is reduced.

FIGS. 3A and 3B give the results for a shadow mask of the slotted type. Such shadow masks are used e.g. in television receivers. The most preferred range of the thickness lies between 1.5 and 4 $\mu$m. For shadow masks of the hexagonal type (in which the apertures of the shadow mask roughly form a hexagonal pattern), the most preferred layer thickness range lies at slightly lower values, namely between 1 and 3 $\mu$m.

Figure 4A:
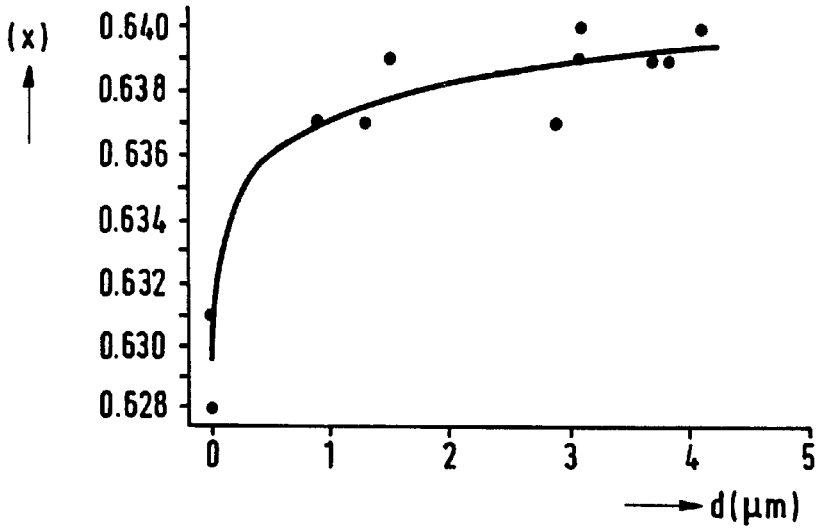
FIG. 4A and 4B graphically shows the relation between the colour point and the thickness of the layer.
Figure 4B:
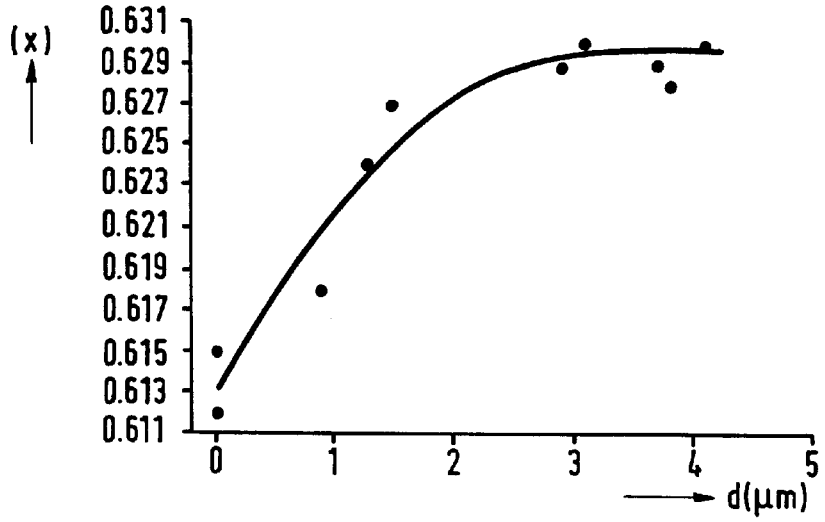

Apart from the improvement in image quality due to an improved colour rendition, the colour saturation of the phosphors is improved. Or, to be more precise, the colour point of the "red", "green" and "blue" phosphors is improved. The effect shown in FIG. 2 (the production of backscattered electrons) means that, even when only one type of phosphor (e.g. the red phosphor) is directly excited by the electron beams, some blue and green stray light is produced. Consequently, the "red" colour is contaminated due to the stray light, which means that the colour point is shifted towards blue and/or green. FIGS. 4A and 4B show, as a function of the thickness of layer 22, the x-coordinate of the red colour point in the centre of the screen (FIG. 4A) and in the corners of the screen (FIG. 4B). The x-coordinate is calculated in accordance with the CIE chromaticitydiagram. The x-coordinate of the colour point red is improved by 10 points (0.010) in the centre and 15 points (0.015) in the corners. Improvements of 10 points are clearly perceptible.

The invention also relates to a method of manufacturing a cathode ray tube comprising a means for generating electrons, an electroluminescent phosphor screen, and a colour selection electrode which is positioned between the means and the phosphor screen, characterized in that, during a manufacturing step, a layer of non-conducting material having a Z number below 20 is provided on the shadow mask by means of electrodeposition.

Electrodeposition has a number of advantages. The layer adheres well to the shadow mask, the thickness of the layer is substantially constant over the shadow mask. Furthermore, the density (packing ratio) of the layer is relatively high (50%–70%). Although an increase in contrast is obtained, layers provided by spraying exhibit a reduced adherence to the shadow mask, some variation in the thickness of the layer, and a higher porosity of the layer (a high porosity of the layer means a low packing ratio). Consequently, the visible performance of cathode ray tubes having a sprayed layer on the shadow mask is inferior to the visible performance of cathode ray tubes having a layer obtained by means of electrodeposition, since the luminance is less and a sprayed layer causes more loose particles than an electrodeposited layer, and there is more variation in the thickness of the layer on the shadow mask.

Figure 5:
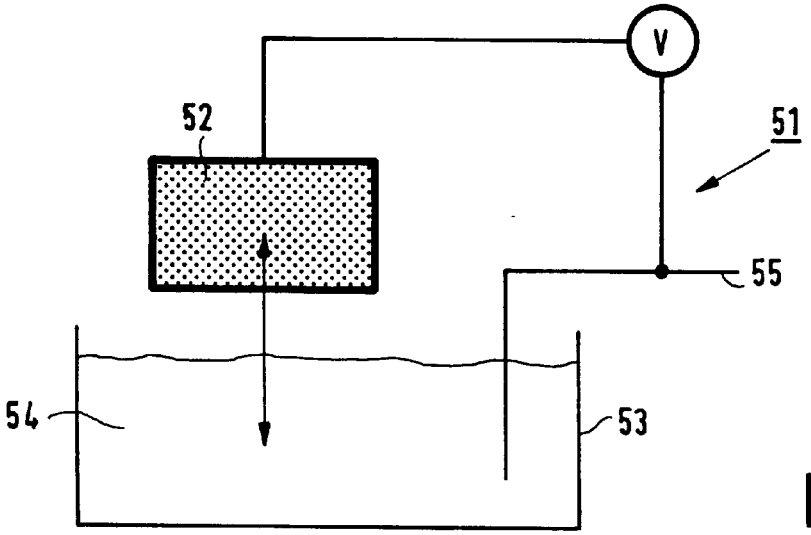
FIG. 5 schematically shows a set-up for electrodepositing a layer on a shadow mask.

FIG. 5 schematically shows a set-up 51 for electrodeposition of an $Al_2O_3$ layer on a shadow mask 52. For example, in a polypropylene bath 53, a suspension 54 for electrodeposition is present, which has, for example, the following composition:

6.14 g $Al_2O_3$ (average particle size 0.2–0.4 $\mu$m)

26.2 g PMA (Polymethylacrylate)

0.0068 g ASA (Anti-static Agent) manufactured by Shell 1000 g Shell-sol (Shell, TD40)

In the bath 53 there is an anode 55 and the shadow mask 52 to be covered is used as a cathode. The mask is introduced into the bath and a layer of $Al_2O_3$ is deposited on the mask, for instance by applying a voltage of 600, 0.16 mA between the mask and the anode for 10–100 seconds depending on the desired thickness. Next the mask is removed from the bath and dried, for instance with IR lamps. Although, when the colour selection electrode is pulled out of the suspension, some of the suspension remains in the holes, which could cause blocking of the holes in the colour selection electrode, it has experimentally been found that such blocking of the holes does not take place. During drying of the suspension, the liquid films in the holes burst open, and a smooth layer is formed.

Instead of PMA other materials such as PAMA (polyalkylmethylacrylate) may be used.

As regards the size of the $Al_2O_3$ particles in the bath it has been found that they should preferably be smaller than 0.5 $\mu$m. As shown above, the provision of the layer 22 on the shadow mask results in an improved image quality. Further improvements are possible by providing a similar layer (a non-conducting layer having preferably approximately the same thickness and a low Z number (Z<20)) on other internal parts of the cathode ray tube. One of such parts is the frame of the shadow-mask. Some electrons are scattered on the frame of the shadow mask. Providing the frame of the shadow mask with a layer 22 further improves the image quality. In a preferred embodiment of the process according to the invention, a layer is electrodeposited on the assembly of a colour selection electrode and the frame of the colour selection electrode. If the cathode tube comprises an IMS (Internal magnetic shield) further improvements of the image quality are obtained if said IMS is also provided with a non-conducting layer of low Z number (Z<20), at least at the surfaces facing the shadow mask. Such a layer has a number of advantages. The capacity of a getter (conventional cathode ray tubes have getters to improve the vacuum in the tube) is increased because there is a separation layer between the getter material and the IMS. The contrast is increased. Preferably the layer is deposited on the IMS by means of electrodeposition. The layer thickness is in the range 1–5 $\mu$m. and preferably the layer has a packing ratio of more than 50%.

The invention has been described by means of examples. Within the framework of the invention many variations are possible.

We claim:

1. Colour cathode ray tube comprising a means for generating electrons, an electroluminescent phosphor screen, and a colour selection electrode positioned between the means and the phosphor screen, characterized in that, the colour selection electrode is covered, at least at the surface of the colour selection electrode facing the phosphor screen, with a layer of an electrically non-conducting material having an average atomic number Z of less than 20 (Z<20) of an average thickness of about 0.5–4.5 $\mu$m.

2. Colour cathode ray tube as claimed in claim 1, characterized in that the material with a low Z number comprises a material of the group consisting $Al_2O_3$ (Aluminum Oxide), $SiO_2$ (Silicon Oxide) and BN (Boron-Nitride).

3. Colour cathode ray tube as claimed in claim 1 charaacterized in that the packing ratio of the layer is higher than 50%.

4. A color cathode ray tube of claim 1, wherein an internal magnetic shield is provided, a surface of which faces the covered surface of the color selection electrode and is covered with a layer of an electrically non-conducting material having an average atomic number Z of less than 20 (Z<20).

* * * * *